US006334442B1

(12) United States Patent
Altamura

(10) Patent No.: US 6,334,442 B1
(45) Date of Patent: Jan. 1, 2002

(54) RECUMBENT THERAPEUTIC SUPPORT

(76) Inventor: Michael J. Altamura, 35 S. Riverside Ave., Croton On Hudson, NY (US) 10520

( * ) Notice: Subject to any disclaimer, the term of this patent is extended or adjusted under 35 U.S.C. 154(b) by 0 days.

(21) Appl. No.: 09/480,243

(22) Filed: Jan. 10, 2000

(51) Int. Cl.[7] ..... A61G 15/00

(52) U.S. Cl. ..... 128/845; 5/632; 5/734; 5/736

(58) Field of Search ..... 128/845, 846, 128/869, 870; 5/630, 632, 731, 734, 736

(56) References Cited

U.S. PATENT DOCUMENTS

| | | | | |
|---|---|---|---|---|
| 3,648,308 A | | 3/1972 | Greenawalt | |
| 4,193,150 A | | 3/1980 | Vineberg | |
| 4,566,449 A | | 1/1986 | Smith | |
| 4,685,163 A | * | 8/1987 | Quillen | 5/455 |
| 4,853,993 A | | 8/1989 | Walpin | |
| 4,862,535 A | | 9/1989 | Roberts | |
| 5,121,961 A | * | 6/1992 | Marshall | 297/17 |
| 5,431,618 A | | 7/1995 | Levi | |
| 5,439,008 A | | 8/1995 | Bowman | |
| 5,713,091 A | * | 2/1998 | Houchin | 5/660 |

* cited by examiner

*Primary Examiner*—Michael A. Brown
(74) *Attorney, Agent, or Firm*—Natter & Natter

(57) ABSTRACT

A therapeutic support is configured for recumbent elevation of a patient's upper torso such that the patient's spine is downwardly inclined at an angle within a range of 5° through 20°, with the patient's head elevated in the order of nine through twelve inches above the gluteus maximus. From the lowest elevation of the upper torso section, the support includes a reverse slope section which supports the gluteus maximus and thighs of the patient. The reverse slope section extends at an angle within a range of 15° to 25°. From the upper limit of the reverse slope section, the support includes a lower leg support section which extends horizontally to beyond the patient's feet. The reverse slope section assures that the patient rests comfortably in a supine recumbent position and will slip downwardly from the upper torso section. The mattress can be fabricated from a suitable foam, e.g. fire retardant polyurethane flexible foam or may comprise an appropriately contoured air mattress or waterbed mattress.

17 Claims, 2 Drawing Sheets

RECUMBENT THERAPEUTIC SUPPORT

BACKGROUND OF THE INVENTION

1. Field of the Invention

This invention relates generally to treatment of gastroesophageal reflux disease and more particularly to a supine torso support.

2. Antecedents of the Invention

The gastroesophageal junction functions as an antireflux barrier against acid ref lux from the stomach to the esophagus. Gastroesophageal reflux disease (GERD) results when reflux factors such as volume and acidity of refluxed stomach acid outweigh counteractive factors, such as esophageal clearance and esophageal mucosal resistance.

The integrity of the antireflux barrier is dependent on many factors including intrinsic lower esophageal sphincter pressure. Among other factors bearing upon the integrity of the gastroesophageal junction antireflux barrier are the maintenance of an acute angle of entry of the esophagus into the stomach, extrinsic compression of the lower esophageal sphincter by the crural diaphragm and the integrity of the phrenoesophageal ligament.

Optimally the antireflux barrier maintains its integrity in a variety of situations. To prevent reflux during swallowing, the intra-abdominal location of the lower esophageal sphincter is of significance; intrinsic lower esophageal sphincter pressure is significant when one is in a recumbent position.

While dietary constraints have proven effective, especially in conjunction with stomach acid reducing medications, it has long been acknowledged that providing an appropriate upper torso slope for a patient in the recumbent position is not only beneficial to esophageal clearance when a patient is sleeping, but also reduces the frequency of tangent lower esophageal sphincter relaxations.

Unfortunately, a recumbent patient propped on a wedge support, with the head elevated, was not assured a restful sleep due to the intrinsic effects of gravity. The patient's torso often slid downwardly from the inclined wedge. As the patient slid, not only was sleeping uncomfortable, but additionally, the maintenance of the gastroesophageal barrier and esophageal clearance were compromised.

Attempts to alleviate this phenomenon, especially in conjunction with infants, are illustrated in U.S. Pat. No. 5,439,008 issued to BOWMAN and U.S. Pat. No. 4,862,535, issued to ROBERTS. The BOWMAN patent disclosed a wedge shaped support for an infant combined with restraint straps to preclude free movement and assure that the infant would not slide from the support. In ROBERTS, the infant was restrained in a sling secured by a hook and loop type fastener. Similarly, U.S. Pat. No. 4,566,449, issued to SMITH, disclosed a wedge-shaped infant support which includes a U-shaped restraint barrier.

SUMMARY OF THE INVENTION

A therapeutic support for alleviation of gastroesophageal reflux disease includes a sloped upper torso section which supports a supine patient at a downwardly inclined angel in the order of 5° through 20° and preferably within the range of 10° to 15°.

From the lowermost elevation of the upper torso section, the support extends upwardly in a reverse slope section at an angle in the order of 15° to 25° for cradling the patient's gluteus maximus and thighs. The reverse slope section assures that the patient will not slip downwardly from the upper torso section. The reverse slope section terminates at approximately the knees. Thereafter, the therapeutic support extends in a generally horizontal plane to support the patient's legs and feet.

The therapeutic support can be fabricated of a suitable resilient foam e.g. polyurethane or may comprise an air or waterbed mattress; it may comprise a complete mattress to be placed on a box spring or bed springs or be placed atop a conventional mattress.

From the foregoing compendium, it will be appreciated that it is a consideration of the present invention to provide a recumbent therapeutic support of the general character described which is not subject to the disadvantages of the antecedents of the invention aforementioned.

A feature of the present invention is to provide a recumbent therapeutic support of the general character described which effectively promotes restful sleep.

An aspect of the present invention is to provide a therapeutic support of the general character described which retards reflux during recumbency.

Another feature of the present invention is to provide a recumbent therapeutic support of the general character described which is effective yet relatively low in cost.

A further consideration of the present invention is to provide a recumbent therapeutic support of the general character described of fire retardant construction.

Another aspect of the present invention is to provide a recumbent therapeutic support of the general character described which precludes a supine patient from slipping from an upper torso incline while assuring the patient's comfort.

A still further consideration of the present invention is to provide a recumbent therapeutic support of the general character described which is portable and thus well suited for use when travelling.

To provide a recumbent therapeutic support of the general character described which comfortably supports the lower extremities is yet a further aspect of the present invention.

A still further feature of the present invention is to provide a recumbent therapeutic support of the general character described which is well suited for mass production fabrication.

To provide a recumbent therapeutic support of the general character described with hypoallergenic characteristics is a further consideration of the present invention.

A still further aspect of the present invention is to provide a recumbent therapeutic support of the general character described which is efficacious in a gastroesophageal reflux disease therapy regimen.

Yet another consideration of the present invention is to provide a recumbent therapeutic support of the general character described which is effective in reducing lower back stiffness.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which is more particularly pointed out and indicated in the appended claims.

BRIEF DESCRIPTION OF THE DRAWINGS

In the accompanying drawings, in which is shown some of the various possible exemplary embodiments of the invention.

DESCRIPTION OF THE PREFERRED EMBODIMENTS

Figure 1:
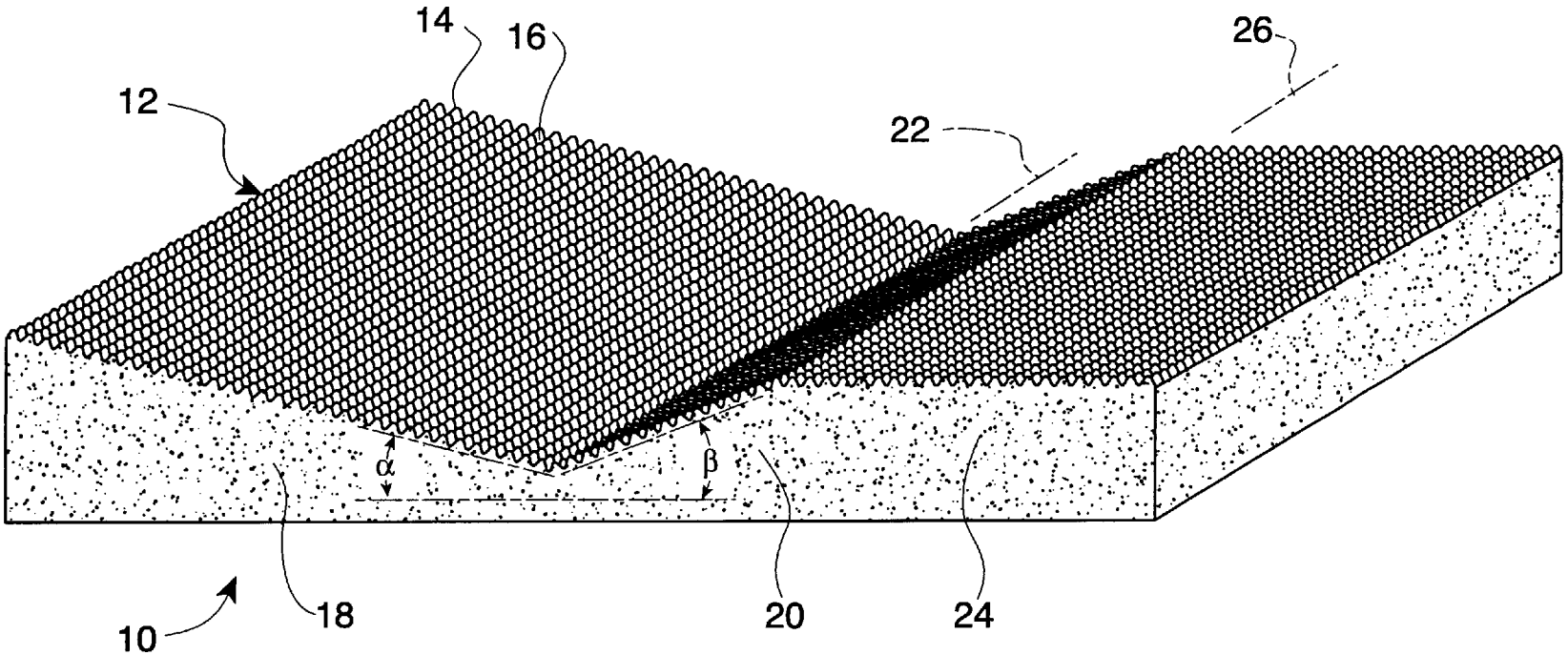
FIG. 1 is an isometric illustration of a recumbent therapeutic support constructed in accordance with and embodying the invention and comprising three sections, with a first torso support section inclined downwardly, a reverse slope section inclined upwardly and a generally horizontal leg support section.

Referring now in detail to the drawings, a recumbent therapeutic support 10 is configured to support a supine patient in a posture which assists in maintenance of the gastroesophageal barrier and esophageal clearance as well as restful comfort and relief of lower back pain.

The support 10 may be fabricated as a unitary slab of a suitable material which is both resilient and somewhat compressible, such as fire retardant polyurethane foam. Alternately, the recumbent therapeutic support 10 may be fabricated of a film envelope as an air mattress or waterbed.

The support 10 is generally rectangular in plan configuration, having lengths and widths approximating that of a bed mattress e.g. twin, queen, king, etc. An upper surface 12 of the support has an egg carton contour with a plurality of evenly spaced alternating conical projections 14 and depressions 16 which facilitates air circulation beneath the patient.

In accordance with the invention, the support 10 includes a torso support section 18, wherein the upper surface 12, is generally planar and sloped downwardly from a head end of the support toward the mid-length of the support. A typical efficacious downward slope angle is approximately 14°, however, it is believed that beneficial results can be attained with slope angles ranging from as low as 5° to as high as 20°. The height of the support 10 at the head end may be approximately twelve inches.

From the lowermost point of the torso support section, the upper surface 12 extends upwardly in a reverse slope section 20. The upper surface 12 of the reverse slope section 20 is also generally planar and intersects the upper surface of the torso support section at a juncture line 22, with the height of the support being approximately three inches at the juncture line 22 and with the distance between the maximum height head end and the juncture line 22, being approximately thirty six inches.

From the reverse slope section 20, a leg support section 24 extends. The upper surface of the leg support section is horizontal.

The junction between the upper surface planes of the reverse slope section 20 and the leg support section 24 comprises a line 26 with the distance between the line 26 and the line 22 is approximately fifteen inches.

It should be noted that in the reverse slope section 20, the upper surf ace 12 extends at an angle β which is significantly greater than the angle , for example, in the order of 15° to 25° with an angle β of 20° having been found efficacious.

It should be appreciated that the recumbent therapeutic support 10 may be placed over a conventional mattress or may be employed in lieu of a convention mattress and placed over bed springs or a box spring. The support 10 is also well-suited to be placed directly on a hard floor. If constructed as an air mattress, it may be easily transported from place to place in fully collapsed position to be inflated when needed, including, for example, at a beach, park, pool or other recreational area as well as in the bedroom.

The support 10 may be fabricated of a flame retardant polyurethane which is hypoallergenic and which may be folded or rolled for transport. For added comfort, the support 10 may be covered with a form fitted bed sheet or other covering. The foam may be supplied in a variety of compression densities so that a user may select a support 10 with a degree of firmness most suited for therapeutic advantage as well as comfort. Additionally, variable density foam construction may be employed for selective degrees of firmness only in a portion of the support, e.g. back, thighs, etc.

Figure 2:
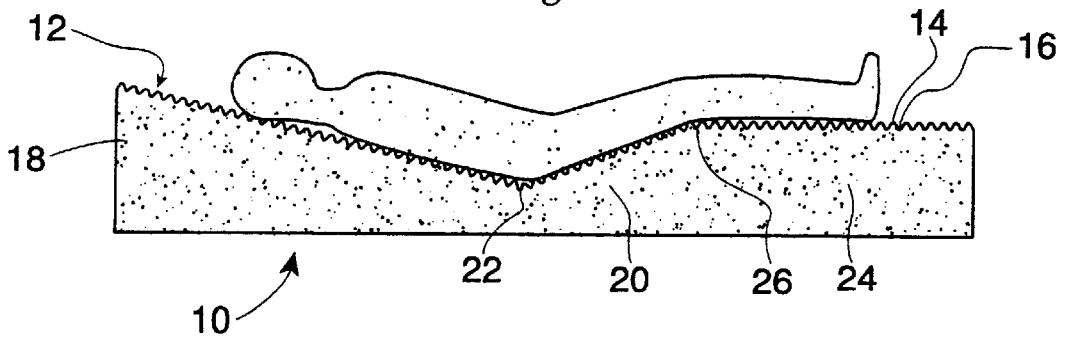
FIG. 2 is a front elevational view of the recumbent therapeutic support and illustrating, in schematized format, a supine patient resting on the support.

With reference now to FIG. 2 wherein the recumbent therapeutic support 10 is depicted in a side elevational view with a schematized representation of a patient resting in a supine position, it should be noted that the depiction of the patient is merely for the purpose of illustration and the schematized drawing omits certain aspects, such as compression of the support as a result of the patient's weight, a depiction of the patient's head resting upon a pillow, etc.

An examination of FIG. 2 will reveal that the patient's upper torso lies upon the upper surface 12 of the torso support section 18 with the patient's spine generally at the sloped angle of the upper surface 12, e.g. 14°. The patient's pelvic area at the base of the patient's spine lies transverse to the juncture line 22 and the upper surface of the reverse slope section 20 supports the patient's thighs at the upward incline angle β.

From the juncture line 22 at the beginning of the reverse support section 20 to the juncture line 26, at the end of the reverse slope section, the patient's gluteus maximus and thighs are cradled and supported so that the patient cannot slip downwardly from the torso support section 18.

It is also significant that the juncture line 26 coincides approximately with the patient's knee joint and the upper surface 12 of the support 10 extends in a horizontal plane in the leg support section 24. It should be noted that the patient's legs are maintained at an elevation, e.g. nine inches, which is approximately that of or slightly lower than the patient's head. Such position has been found to promote restful sleep and reduce the occurrence of morning lower back ache.

Figure 3:
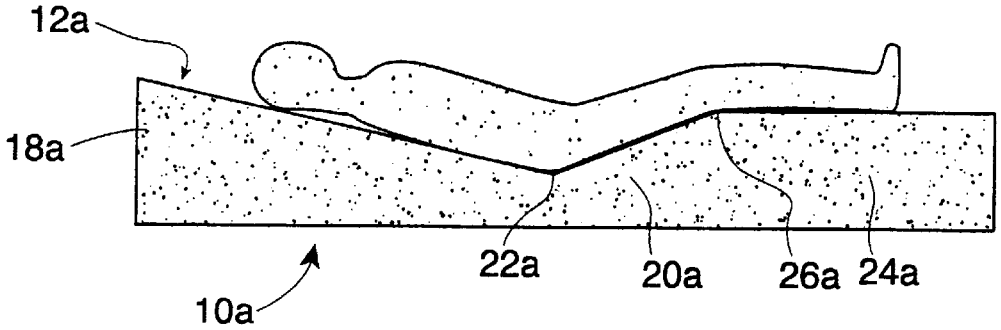
FIG. 3 is a schematized front elevational view of an alternate embodiment of the invention wherein the upper surface of the support is generally smooth and planar.

Turning now to FIG. 3 wherein an alternate embodiment of the invention is shown, like numerals will be employed to denote like components of the previous embodiment, however bearing the suffix "a". In the FIG. 3 embodiment, a recumbent therapeutic support 10*a* is configured substantially the same as that of the prior embodiment with a torso support section 18*a*, a reverse slope section 20*a* and a leg support section 24*a*. The upper surface 12*a* of the support 10*a* is generally smooth and planar throughout each section and the egg carton shaped conical projections and depressions are not employed.

Figure 4:
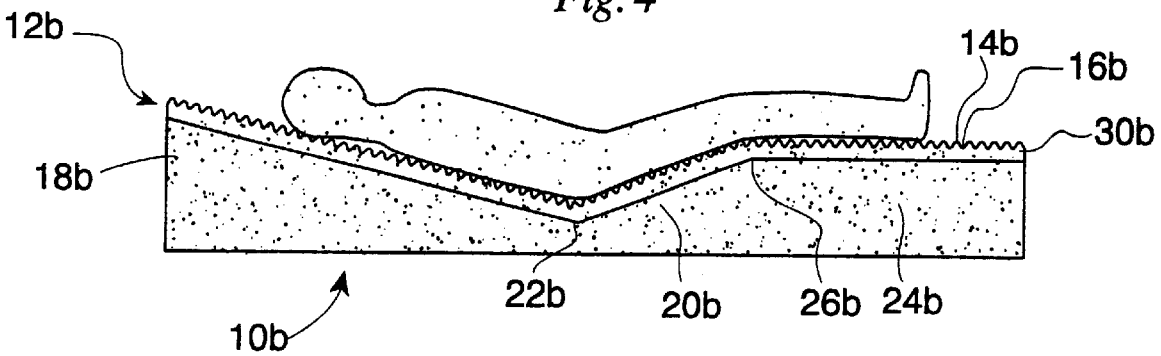
FIG. 4 is a schematized front elevational view of a further embodiment of the invention wherein the upper surface of the support is generally planar as in the FIG. 3 embodiment, however being covered by a pad.

In FIG. 4 a further embodiment of the invention is illustrated, with like numerals being employed for like components of the prior embodiments, however bearing the suffix "b". It should be noted that the FIG. 4 embodiment is substantially similar to the FIG. 3 embodiment, with a generally smooth planar upper surface 12*b*. The upper surface 12*b* is covered, however, with a sheetlike padding 30*b* of a suitable foam material, such as fire retardant polyurethane foam.

An upper surface of the padding 30*b* is contoured with the pattern of conical projections and depressions 14*b*, 16*b*, respectively in an egg carton configuration. The FIG. 4 embodiment is particularly suited for use in conjunction with multiple patients whereby the padding 30*b* may be discarded after each patient's use. Employment of the padding 30*b* also facilitates the placement of a moisture or other sheet barrier between the upper surface 12*b* and the padding 30*b*.

Additionally, the utilization of the padding 30*b* facilitates the employment of different densities of support materials. For example, the padding 30 may comprise a low density easily compressible polyurethane foam while the support may comprise a high density foam throughout or within specified areas.

Figure 5:
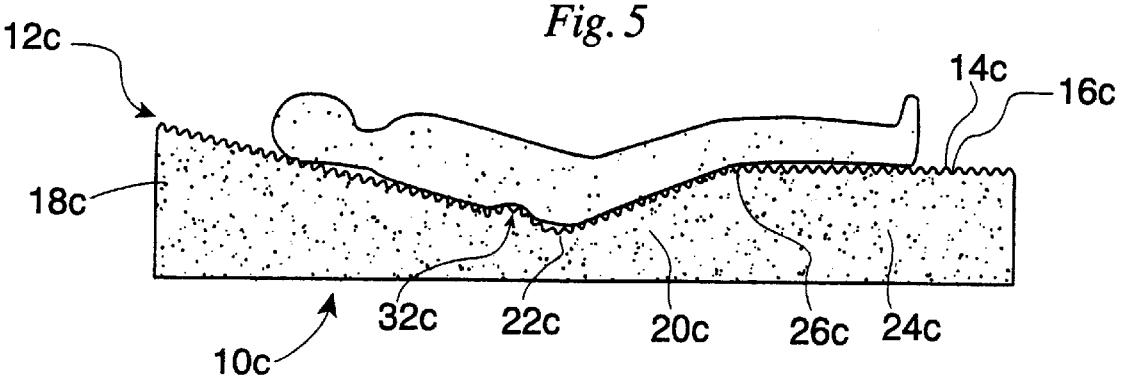
FIG. 5 is a front elevational view of another embodiment of the invention, similar to that of the first embodiment, however, with the upper surface of the torso support section including a lumbar support.

A still further embodiment of the invention is illustrated in FIG. 5 wherein like numerals have been employed to denote like components of the prior embodiments, however bearing the suffix "c". The FIG. 5 embodiment of a recumbent therapeutic support 10*c* is constructed substantially identical to the FIG. 1 and FIG. 2 embodiment, however, a planar upper surface 12*c* of a torso support section 18*c* is interrupted by a transverse lumbar support roll 32*c* which extends across the entire width of the upper surface 12*c*.

Thus it will be seen that there is provided a recumbent therapeutic support which achieves the various aspects, features and considerations of the present invention and which is well suited to meet the conditions of practical usage.

As various possible embodiments might be made of the present invention and various changes might be made in the embodiments of the recumbent therapeutic support as above set forth, it is to be understood that all matter herein described or shown in the accompanying drawings is to be interpreted as illustrative and not in the limiting sense.

Having thus described the invention, there is claimed as new and desired to be secured by Letters Patent:

1. A recumbent therapeutic support for a supine patient, the support comprising a torso section adapted to be positioned beneath a patient's back, the torso section having an upper support surface, the upper support surface being inclined downwardly from a maximum height adjacent the patient's head to a minimum height adjacent the base of the patient's spine, at an angle of inclination within a range of 5° to 20°, the support further including a reverse slope section adapted to be positioned beneath the patient's gluteus maximus and thighs, the reverse slope section having an upper surface inclined upwardly at an angle within the range of 15° to 25°, the reverse slope section having a minimum height at the minimum height of the torso section, the torso section and the reverse slope section being dimensionally fixed relative to one another, whereby the patient will not slide from the torso section.

2. The recumbent therapeutic support for a supine patient as constructed in accordance with claim 1 wherein the torso section and the reverse slope section are formed of one piece construction.

3. A recumbent therapeutic support for a supine patient as constructed in accordance with claim 1 wherein the angle of inclination of the torso section is in the order of 14°.

4. A recumbent therapeutic support for a supine patient as constructed in accordance with claim 1 wherein the angle of inclination of the reverse slope section is in the order of 21°.

5. A recumbent therapeutic support for a supine patient as constructed in accordance with claim 1 further including a leg support section, the leg support section having a horizontal upper support surface, the reverse slope section having a maximum height, the support surface of the leg support section having a height equal to the maximum height of the reverse slope section.

6. A recumbent therapeutic support for a supine patient as constructed in accordance with claim 5 wherein the torso section, the reverse slope section and the leg support section are formed of one piece construction.

7. A recumbent therapeutic support for a supine patient as constructed in accordance with claim 1 wherein the torso section and the reverse slope section are formed of the fire retardant polyurethane foam.

8. A recumbent therapeutic support for a supine patient as constructed in accordance with claim 1, the upper support surface being patterned in an egg carton configuration.

9. A recumbent therapeutic support for a supine patient as constructed in accordance with claim 2 wherein the support comprises a fluid filled envelope.

10. A recumbent therapeutic support for a supine patient as constructed in accordance with claim 1 wherein the torso section of the reverse slope section are formed of a polyurethane foam of the variable density.

11. A recumbent therapeutic support for a supine patient as constructed in accordance with claim 1 wherein the upper support surface is generally smooth and planar.

12. A recumbent therapeutic support for a supine patient as constructed in accordance with claim 11 further including a length of padding positioned atop the upper support surface, the padding including a face abutting the upper support surface and an opposite face, the opposite face having an egg carton configuration.

13. A recumbent therapeutic support for a supine patient as constructed in accordance with claim 1 wherein the upper surface of the torso section includes a lumbar support.

14. A treatment regimen for the alleviation of gastroesophageal reflux disease during periods when a patient is recumbent, the regimen comprising the step of:

(a) providing recumbent therapeutic support constructed in accordance with claim 1, and (b) lying a patient in a supine position on the support.

15. A treatment regimen for alleviation of gastroesophageal reflux disease as constructed in accordance with claim 14 wherein step (b) includes lying the patient in a supine position with the patient's spine downwardly inclined at an angle within the range of 12° to 15°.

16. A treatment regimen for the alleviation of gastroesophageal ref lux disease in a recumbent patient, the regimen comprising the steps of:

(a) lying the patient in a supine position with a downward incline to the spine within the range of 10° to 15°, and (b) elevating the patient's thighs at an angle of approximately 18° to 23°.

17. A treatment regimen for the alleviation of gastroesophageal reflux disease in a recumbent patient in accordance with claim 16 further including the step of (c) supporting the patient's legs from below the knee in a horizontal position.

* * * * *